US006398432B1

(12) United States Patent
Day et al.

(10) Patent No.: US 6,398,432 B1
(45) Date of Patent: Jun. 4, 2002

(54) PRINTER WITH FAILSAFE FEATURES

(75) Inventors: Robert Charles Lewis Day, Nr. Royston; Lawrence Archard; Jonathan Kemp, both of Cambridge; Charles Robert Sims, Royston; Adrian Michael Woodward, Nr. Royston; Chris McCleve, London; Martin Gibbs, Udimore; Michel Woodman, Huntingdon, all of (GB); Geert Heyse, Sint Katelijne Waver (BE)

(73) Assignee: Esselte N.V., Sint-Niklaas (BE)

( * ) Notice: Subject to any disclaimer, the term of this patent is extended or adjusted under 35 U.S.C. 154(b) by 0 days.

(21) Appl. No.: 09/438,545

(22) Filed: Nov. 12, 1999

(30) Foreign Application Priority Data

Nov. 13, 1998 (GB) ..... 9825024

(51) Int. Cl.[7] ..... B41J 3/36
(52) U.S. Cl. ..... 400/88; 346/143; 347/109
(58) Field of Search ..... 400/88, 61, 70, 400/76, 279, 283; 347/108, 109; 346/141, 142, 143

(56) References Cited

U.S. PATENT DOCUMENTS

| | | | | |
|---|---|---|---|---|
| 5,063,451 A | | 11/1991 | Yanagisawa et al. | 346/143 |
| 5,126,955 A | * | 6/1992 | Tomoda | 364/708 |
| 5,308,173 A | * | 5/1994 | Amano et al. | 400/29 |
| 5,311,208 A | * | 5/1994 | Burger et al. | 345/163 |
| 5,634,730 A | | 6/1997 | Bobry | 400/88 |
| 5,685,651 A | | 11/1997 | Hayman et al. | 400/88 |
| 5,825,995 A | | 10/1998 | Wiklof et al. | 395/117 |

FOREIGN PATENT DOCUMENTS

| | | |
|---|---|---|
| EP | 0 598 251 | 5/1994 |

* cited by examiner

*Primary Examiner*—Andrew H. Hirshfeld
*Assistant Examiner*—Minh H. Chau
(74) *Attorney, Agent, or Firm*—Pennie & Edmonds LLP

(57) ABSTRACT

A portable printer which can print on a variety of surfaces is disclosed. The printer has a number of failsafe features which improve its operation and the quality of print. In particular, printing is inhibited in a certain number of situations. Alternatively or additionally, a maintenance sequence can be implemented when the printing unit is removed from a base location. A set of absorbent strips additionally or alternatively allow for the ink jet nozzles to be discharged within the print area.

12 Claims, 8 Drawing Sheets

PRINTER WITH FAILSAFE FEATURES

FIELD OF THE INVENTION

The present invention relates to a printer, and particularly, but not exclusively to a portable printer which can print on a variety of surfaces.

BACKGROUND TO THE INVENTION

In the state of the art, a number of printers capable of "direct" printing is known. Direct printing in the context of the present invention means that the printer is placed on the image receiving medium, usually manually, and the printing means of the printer or the entire printer then scans over the image receiving medium in the printing operation. Thus, the medium is not fed through the printer—as in most office printers—but the printer moves over the medium.

Such a printer is known from EP 564297-A. The printer has an ink jet print head which scans in two orthogonal directions over the image receiving medium, onto which the printer is placed manually. The printer is connected to a computer and capable, e.g of printing addresses onto envelopes, but can also be used separately from the computer for printing data downloaded from the computer to the printer.

Another ink jet printer to be placed on a printing medium is disclosed in U.S. Pat. No. 5,634,730. This printer is provided with a keyboard for data inputting, but can also print images downloaded from a computer. The print head scans over the image receiving medium along a special path, e.g. helically or like a pendulum. DE 3142937-A refers to a so-called hand stamp which is placed manually on the image receiving medium. It can print data downloaded from an accounting machine, or images consisting of user-selected fixed phrases. The hand stamp has a thermal print head and an ink ribbon for printing.

The direct printers known in the prior art are thus capable of printing an image onto an image receiving medium, and make use of a scanning print head. JP-6286227 discloses an electronic stamping apparatus which includes a pressure detection means that detects whether the pressure applied to an object is in a prescribed range, and a control means that controls scanning of a thermal transfer head based on the detection by the pressure detection means. This requires contact between the print head and the surface to be printed, in contrast to the printers described herein where the print head is spaced from the image receiving medium.

SUMMARY OF THE INVENTION

It is an aim of the present invention to improve the quality of images which are printed by the so-called direct printers. According to various aspects of the invention, this can be done in a number of different ways.

According to one aspect of the invention there is provided a printer comprising:

a housing arranged to be manually positioned on an image receiving medium at a printing location and defining an area over which printing is effected; a printing mechanism operable to effect printing over said area with the housing at said printing location; means for detecting relative movement between the image receiving medium and the housing during printing; and a controller for inhibiting printing when such relative movement is detected.

The means for detecting relative movement may be for example a scanner head, mouse ball etc. Thus, any relative motion detected during the print cycle may be used to interrupt or terminate the print cycle.

According to another aspect of the invention there is provided a printer comprising: a housing arranged to be manually position on an image receiving medium at a printing location and defining an area over which printing is effected; a printing mechanism operable to effect printing over said area with the housing at said printing location; means for detecting orientation of the housing with respect to the image receiving medium during printing; and a controller for inhibiting printing when an orientation other than a correct predetermined orientation is detected.

The means for detecting orientation of the housing can be for example a tilt sensor. Thus, the tilt sensor enables the print cycle to be inhibited unless the printer is positioned in the correct orientation.

According to a further aspect of the invention there is provided a printer comprising: a housing arranged to be manually positioned on an image receiving medium and defining an area over which printing is effected; a print head having a plurality of ink jet nozzles and mounted in said housing for travel within said housing relative to the image receiving medium to effect printing, said print head having an extent of travel which extends in a region outside the printing area; a controller for actuating said ink jet nozzles in said region as a maintenance procedure; and a set of absorbent strips arranged in said region for receiving ink ejected from the jet nozzles during the maintenance procedure.

By using the unprintable area for interim "spitting", the print function can be maintained by preventing individual jets from blocking. The absorbent strips which are used to catch any drops of ink spat out may be replaceable.

According to a further aspect of the present invention there is provided a printer comprising: a housing arranged to be manually positioned on an image receiving medium at a printing location and defining an area over which printing is effected; a print head mounted in said housing for travel within said housing relative to the image receiving medium to effect printing; a motor for driving said print head under the control of a drive signal; and a controller for generating the drive signal for the motor wherein the controller includes fault condition detecting means which are operable to detect when the drive signal exceeds a predetermined limit and to inhibit printing in said fault condition.

In the described embodiment, the drive signal is an electric current which is supplied to the motor for causing movement of the print head. For an X-Y movement, there are two motors, one for moving the print head along an axis in an X direction and the other for moving the axis itself in a Y direction. Under normal printing loads, the drive current to the X-Y drive motors will follow a repeatable profile. Should the printing mechanism jam or encounter a higher resistance than normal, for example when printing on an uneven surface, the drive motor current will rise. By setting the boundaries that encompass the normal operating currents, current outside these boundaries may be detected as a fault condition and used to inhibit printing.

In another aspect, the invention provides a printing system comprising: a printing unit; a base station configured to receive the printing unit when not in use and having means for detecting return of the printing unit to the base station; and wherein a maintenance sequence for the printing unit is initiated on detection of return of the printing unit to the base station.

In another aspect the invention provides a printer comprising: a housing arranged to be manually positioned on an image receiving medium and having an opening defining an area over which printing is effected; a print head having a plurality of ink jet nozzles and mounted in said housing for travel within said housing relative to the image receiving medium to effect printing, said print head travelling at least within said opening and over said area to effect printing; and a cover removably attachable to said housing to close said opening when said printer is not in use.

For a better understanding of the present invention and to show how the same may be carried into effect, reference will now be made by way of example to the accompanying drawings.

DESCRIPTION OF THE PREFERRED EMBODIMENT

Figure 1:
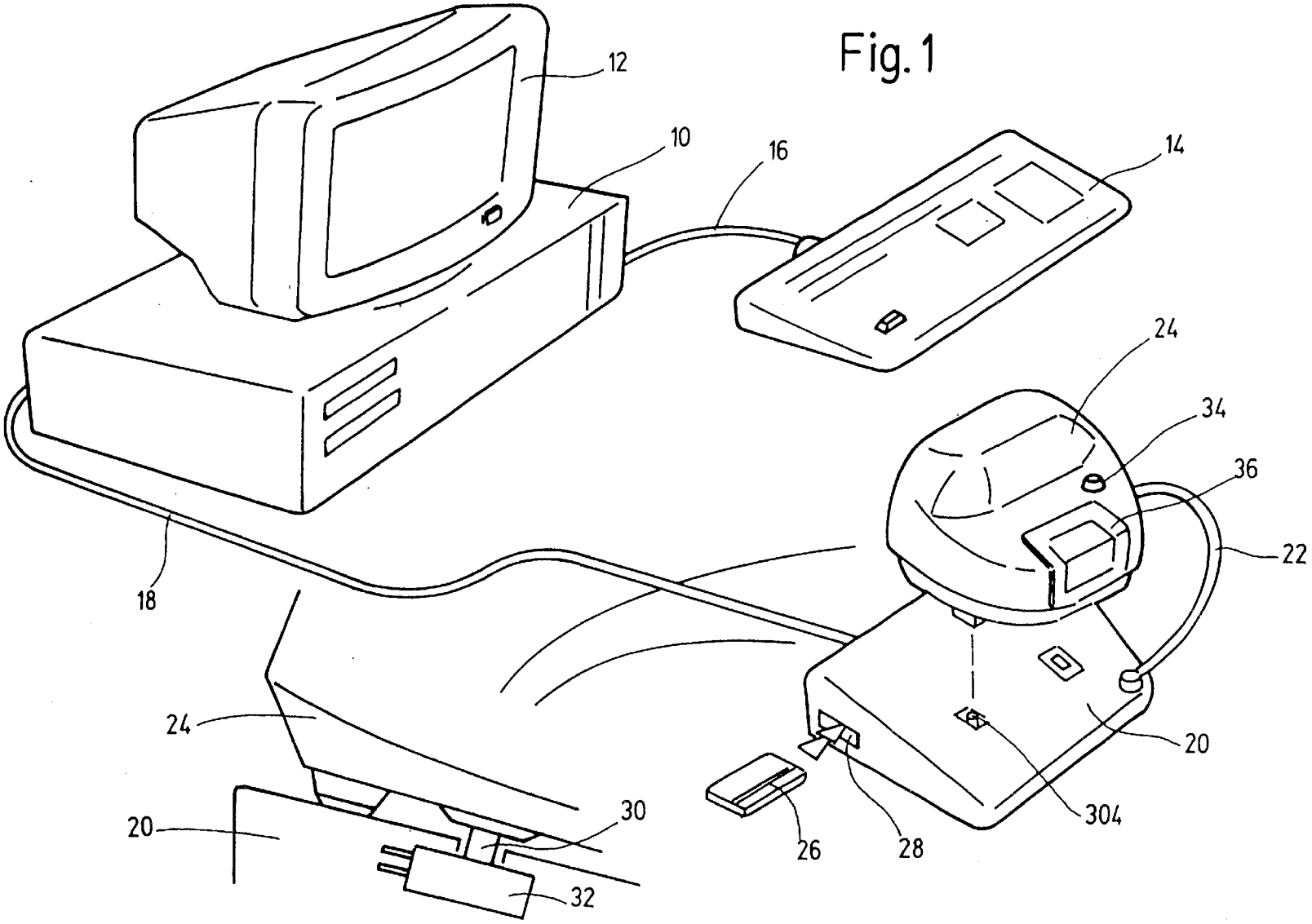
FIG. 1 is a view showing a printer, a base station and a computer.

FIG. 1 shows a printing system consisting of a computer 10, a computer controlled display 12, which is in the described embodiment of the invention a CRT, a keyboard 14 linked to the computer 10 by means of a cable 16, another cable 18, connecting the computer 10 with a base station 20, which is connected to a printer 24 by means of a cable 22. Thus, the printer 24 is linked to the computer 10 via the cables 18, 22 and the base station 20.

As known in the prior art, the computer 10 comprises a processor on which a software is running, comprising an operating system, a printer driver to enable printing with the printer 24 from the operating system, and a software application by which data can be created, selected and formatted on the PC, for defining image patterns to be printed by the printer 24. The software application can be activated in a number of ways:

- selected by the user at start-up or from the desktop: the user places the software application in the start-up directory or creates an icon on the desktop;
- from within another application: the user invokes the software application from a button (displayed on the display 12) in the toolbar of another software application;
- from the handheld printer 24 itself: if the application is not running, the user presses a print button 34 on the handheld printer 24, which will automatically invoke the software application in the first instance.

Another possibility to activate the software application on the computer 10 for controlling the printer 24 is to lift the printer 24 off the base station 20. A switch 32 is provided in the base station 24 sensing the presence or absence of the printer 24 by means of a pin 30. When the printer 24 is placed upon the base station, the pin 30 is depressed, and the switch 32 is open. In the case that the printer 24 is removed from the base station 20, the pin 30 which is biased in the vertical direction moves upwardly and the switch 32 opens. The switch is connected via some electronic circuits to the computer 18 and activates the software application for printing.

The base station 20 is connected to the computer 10 by means of the cable 18, which can be a parallel or a USB cable. Electric power is supplied to the base station 20 by a separate mains transformer, but could also be supplied from the computer via the cable 18, preferably when the cable 18 is a USB cable. The cable 18 can be hard wired to the base station 20, or connected to a socket of the base station, which is preferably provided at the rear thereof. When the printer 24 is not in use, the handheld printer will be placed in the base station 20. The base station 20 will ensure that the ink jet print head of the printer 24 is protected when not in use by a capping device that will be automatically triggered whenever the printer is inserted into the base station 20. The base station 20 will also cause the print head of the printer 24 to eject ink into a reservoir and mechanically clear the surface of the print head. These measures are necessary to maintain optimum print quality.

The umbilical cable 22 connects the base station 20 to the hand held printer 24, providing both power and data. A LED on the printer will indicate that power is on. The printer 24 is removed from the base station 24 and positioned on the surface to be printed. The length of the cable 22 limits the distance of travel from the base station.

In another embodiment of the invention, the printer is arranged to be disconnected from the base station by unplugging the umbilical cable 22 and moved to another location where printing of the contents of on-board memory, i.e. downloaded image data, can be effected. The user will employ scroll buttons on the printer to select the required print data, which appear in a small LCD. Once a selection has been made, pressing the print button 34 will activate printing. Having selected the data to print using the software application (or the scroll buttons on the printer), the user will activate printing from the print button 34 on the hand held printer 24 itself.

Print alignment is achieved visually through a transparent window 36 in the printer casing. This window 36 can also be opened for inserting an ink cartridge into the printer 24 before use. The cartridge is then clamped in a carriage of the printer 24. The window 36 must be closed before printing. The user can choose from a range of coloured and special inks. Changing a cartridge is achieved by lifting a retaining lever and extracting the cartridge in use and replacing this with a new or different colour cartridge in the way described above. If the removed cartridge still contains ink and is to be reused it must be capped to avoid the ink drying out.

Alternatively a Think jet type head from Hewlett Packard may be used which utilises a different type of ink which does not dry out in the print head.

The printer 24 contains a print mechanism with the ink jet print head having a number of print nozzles, and an ink supply. The print head is moved by means of motor driven scanning means within the housing in two (generally orthogonal) directions such that a rectangular area can be imprinted through an aperture of the printer 24 at the bottom of its housing. Thus, the printer 24 is placed manually on an image receiving medium and—when the print button 34 is depressed—the print head scans over the medium and imprints it by spitting ink droplets onto it.

FIG. 1 shows the printer 24, base station 20 and computer 10 linked by cables. In an embodiment, it is possible to replace one or all of these links by a wireless link such as a low power RF link or an infra-red link. FIG. 1 also shows the presence of a "Smart Card" reader 28 in the base station 20. Smart cards 26, i.e. memory cards, may be used for storing data or images or as a substitute for additional RAM in the base station. Spare cards may be stored within the base station where a storage compartment is provided (not shown).

In the case that the printer 24 is powered only by batteries, rather than having the cable 22 transmitting power from the base station 20, the amount of charge remaining in the batteries may be monitored an displayed on a display of the printer 24, and/or on the display 12 of the computer 10. If rechargeable batteries are used, the battery monitoring system could also be used to control the charge/discharge cycle of the battery pack to maximise battery life. This could also enable rapid recharging of the batteries. Such a battery management system could also indicate that there was sufficient energy remaining in the battery pack to complete the current task.

The print mechanism of the printer will now be described with reference to FIG. 2. The printer 24 has a housing 200, the underside of which can be abutted against the surface of the image receiving medium to be printed. A print face 11 is defined by the scanning range of an ink jet print head cartridge 126 which can be replaced using the cartridge release mechanism described above. The ink jet print head cartridge 126 is mounted for movement along a write axis 128 by virtue of cooperating lead screw 130 and nut 132. The movement is controlled by a motor 134 (stepper or DC depending on the nature of the print head). The position of the write axis 128 can be altered by an indexing axis lead screw and bush 136 controlled by a further stepper motor 138. Reference numeral 140 designates a stability bar which extends parallel to the write axis 128, the ink jet print head cartridge 126 being mounted between the write axis 128 and the stability bar 140. Reference numeral 142 designates an indexing axis stability bar and bush.

If a Think jet print head is used, a DC motor and encoder may be used in place of a stepper motor.

The printer also includes an electronic controller 100 having a microprocessor for controlling movement of the motor 34 and generating signals for controlling the print head and having a buffer memory for storing data. The microprocessor is capable of converting data from a computer to which the device is connected into a format suitable for driving the print head. The buffer memory can store information in a variety of formats to enable the printer to work with a variety of computer equipment.

Figure 2:
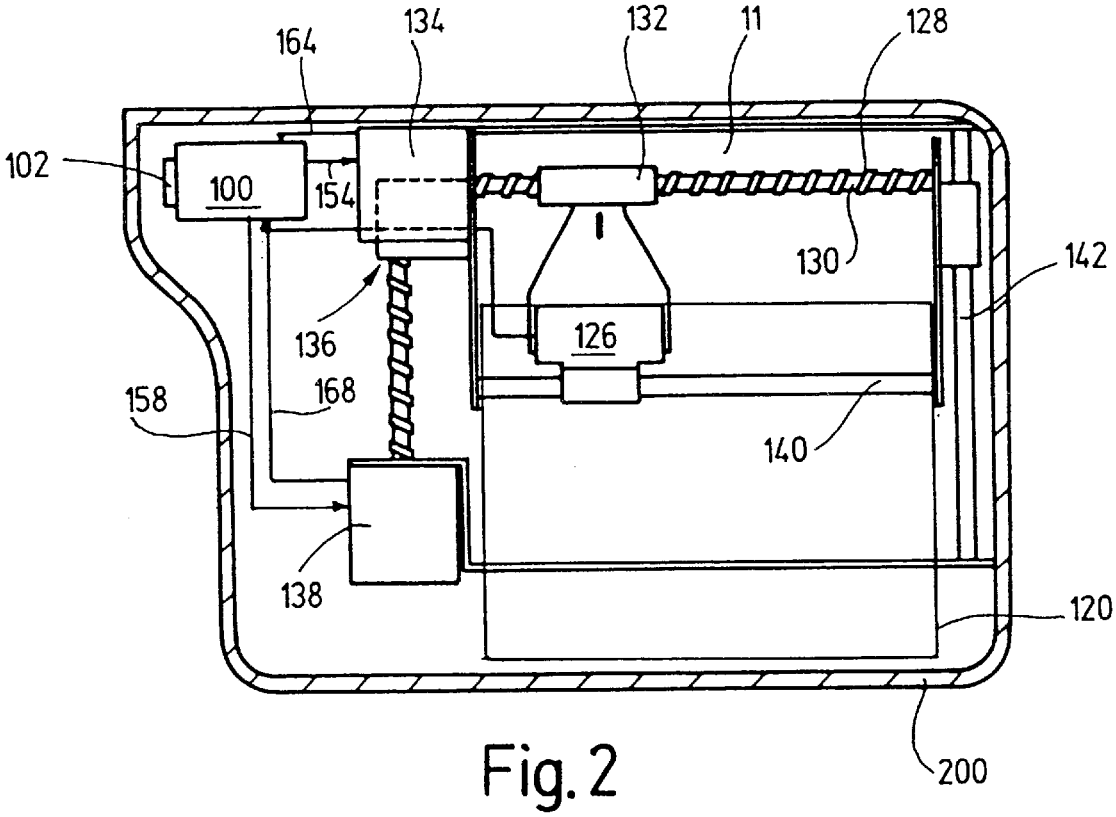
FIG. 2 shows the print mechanism of the printer.

In FIG. 2, the line 120 defines the extent of travel of the print cartridge 126 in the X and Y directions. Referring now to FIG. 3, a print area 122 which is denoted inside the dotted lines 122*a* is defined which does not use up the full extent of travel of the print head cartridge 126. Additional travel is required so that the print head can be accelerated/decelerated to and from optimum print speed and hence firing frequency. If print occurs during acceleration/deceleration, it is necessary to deviate from the print head specified firing frequency and print quality will deteriorate.

Figure 3A:
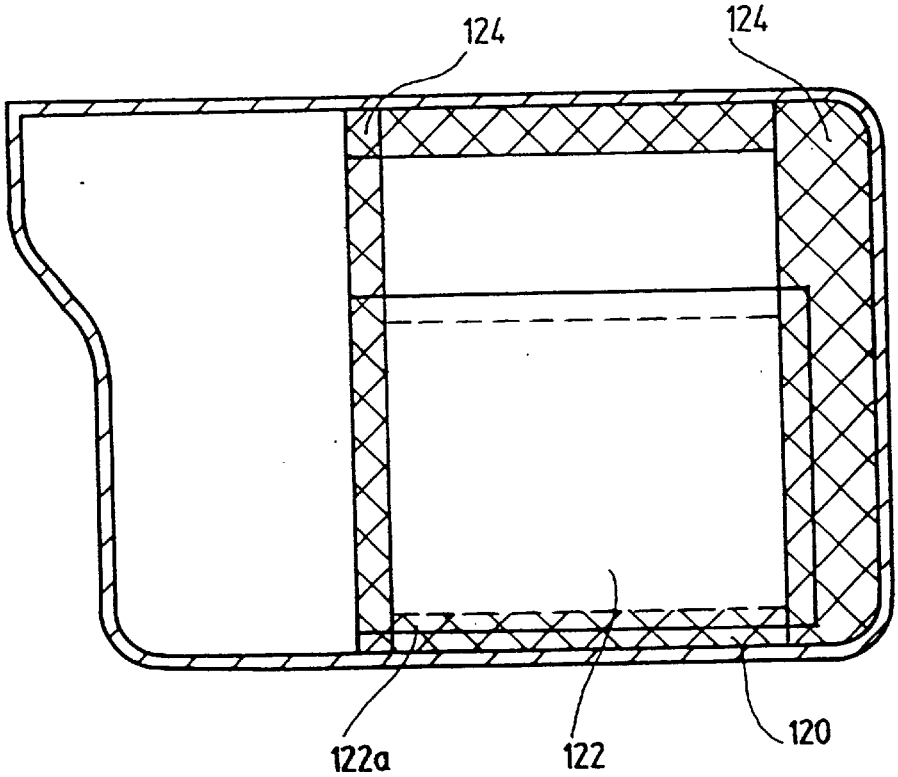
FIG. 3*a* shows the underside of the printer with absorbent strips.

FIG. 3*a* shows the underside of the printing apparatus with all of the drive features removed for the sake of clarity. Thus, it discloses only the travel area 120, the print area 122 and absorbent strips 124. These absorbent strips are placed along the edges of the area of travel of the print head and outside the printing area 122. These absorbent strips allow maintenance of the print head cartridge 126 by allowing ink to be ejected outside the print zone in order to purge the print nozzles and reduce the risk of clogged nozzles. Thus, the unprinted region between lines 120 and 122*a* is used for interim spitting to maintain the print cartridge function by preventing individual jets from blocking. The strips of absorbent material may be replaced and are attached to the base of the printer and used to collect any drops of ink spat out to help maintain the print cartridge print quality. The strips should extend beyond the print head travel area to increase their effective ink capacity. Ink will wick out from the actual "spit" position to the extreme edges of the strips.

Figure 3B:
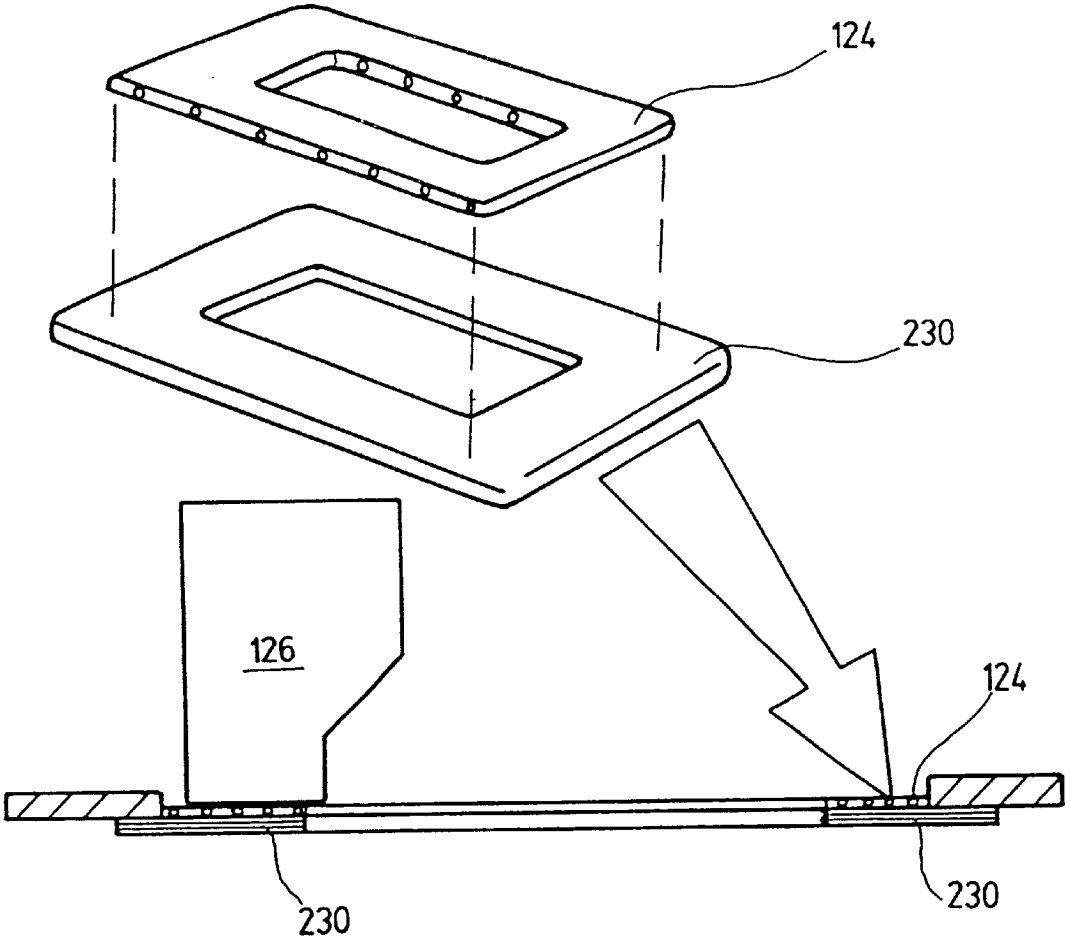
FIG. 3*b* is a perspective view illustrating the use of absorbent strips.

FIG. 3*b* illustrates the concept in more detail, with extraneous components removed for the sake of clarity. That is, in FIG. 3*b* reference numeral 124 denotes a rectangular absorbent strip. Reference numeral 230 denotes a thin fixed guide mounted on the bottom face of the printer 24 in the centre of which a rectangular aperture is provided. The print face is defined within the rectangular aperture. The guide is shown on the substrate in FIG. 3*b* to illustrate its function to allow the print cartridge 126 to pass over it to print to the edge of the print area defined by it.

Figure 4A:
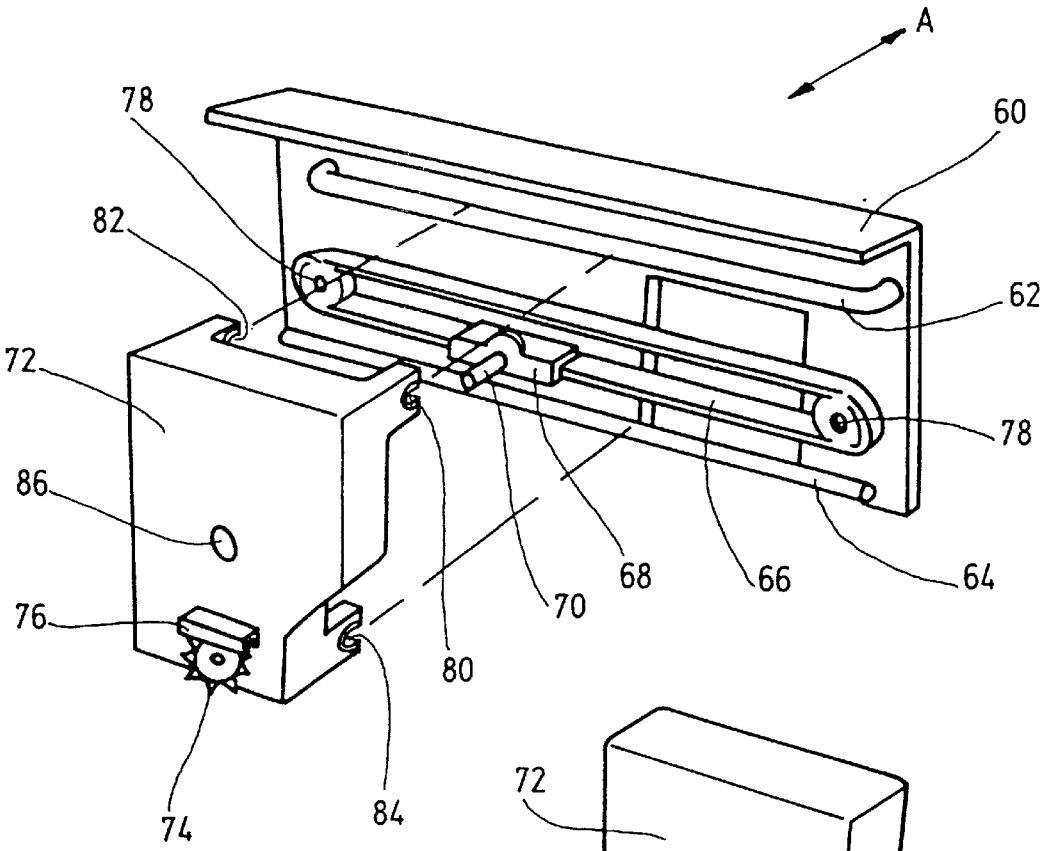
FIG. 4*a* is a view of a mechanism for fixing the print head in the printer.

FIG. 4*a* illustrates how a print cartridge 72 is mounted in the printer 24. A metal (or plastics) base plate 60 is mounted for scanning motion along the direction indicated by arrow A. The necessary mechanism for scanning in this direction is not shown in FIG. 4*a*, for the sake of clarity. On the base plate 60, a first guide rail 62 is provided, and a second guide rail 64. Both guide rails 62, 64 extend in a direction which is orthogonal to the direction of movement of the plate 60. Additionally, two wheels 78 are provided, around which a drive belt 66 is located. The drive belt 66 is preferably toothed and extends parallel to the guide rails 62, 64. Further, a pin 70 is provided on a pin holder 68, the latter being fixed to the drive belt 66. The print cartridge 72 provided with an ink supply and nozzles for depositing the ink onto an image receiving medium is provided with three snap-on bearings 80, 82, 84. The bearings 80 and 82 are arranged to be snapped (or clipped) into the first guide rail 62, and the bearing 84 is arranged to be snapped into the second guide rail 64. Thus, the cartridge 72 can be slidably fixed to the guide rails 62, 64 and travel along the longitudinal axis of the guide rails. The pin 70 engages in a hole 86 of the cartridge, such that a driving connection between the drive belt 66 and the cartridge 72 is established. An electrical connector is incorporated in the pin 70 so that the drive signals can be transmitted to the print head. A dynamic cable (not shown) links the electrical connector with the drive circuitry elsewhere in the product. When the belt is driven (by means of a corresponding motor, not shown in FIG. 4*a* for the sake of clarity, but it could drive the belt 66 through the rectangular window in the base plate 60), the cartridge 72 travels along the guide rails 62, 64. In order to control the print head of the cartridge 72, the printer's control electronic requires information on the position of the print head. Thus, a pinwheel 74 engaging the printed medium is provided on the cartridge. The pinwheel 74 rotates when the cartridge 72 moves along the guide rails 62, 64 and its rotation is detected by means of a motion detector 76.

The pinwheel 74 allows for the detection of the flatness of a substrate to help maintain print quality. As the pinwheel rotates, its rotation is detected by the motion detector 76 and a signal is produced. The pinwheel only rotates when the print cartridge is the correct distance from the substrate and the wheel is in contact with the substrate. At the end of each print pass, when the print cartridge is indexed forward ready to print the next pass, the pinwheel is held clear of the substrate to prevent damage. Alternatively a castor or track ball which can rotate about two orthogonal axes could be used. If the pinwheel loses contact with the substrate during the normal printing pass, the wheel no longer rotates, the signal is lost and the print cycle is inhibited.

The base plate 60 and the pins on which the wheels 78 are mounted, and the guide rails 62, 64 are unitary. Thus, the base plate 60 is produced as a unitary unit, e.g. by die casting, in order to simplify constructions and minimise component cost. It should be noted that a movement along the direction indicated by the arrow A is not necessary when the cartridge 72 contains a print head having a width sufficient to print the entire image receiving medium in one scan.

Figure 4B:
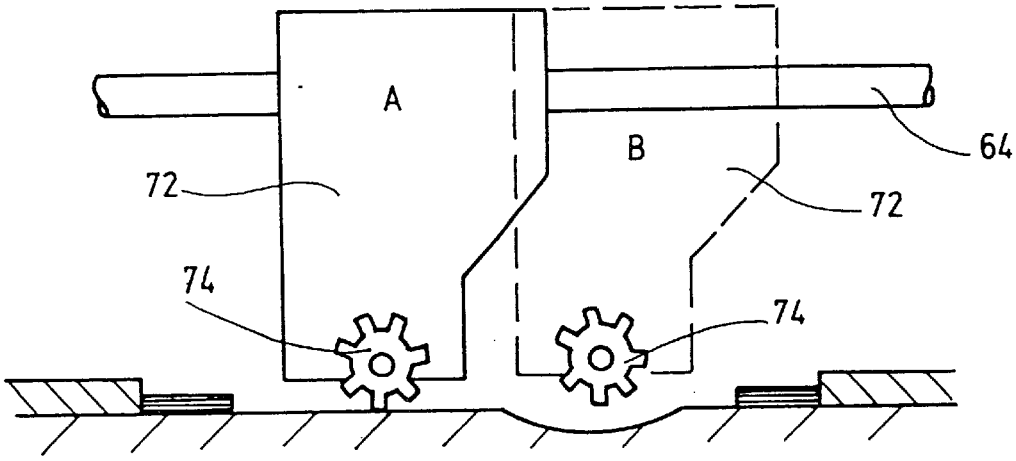
FIGS. 4*b* and 4*c* illustrate how the arrangement of FIG. 4*a* functions as a detector.
Figure 4C:
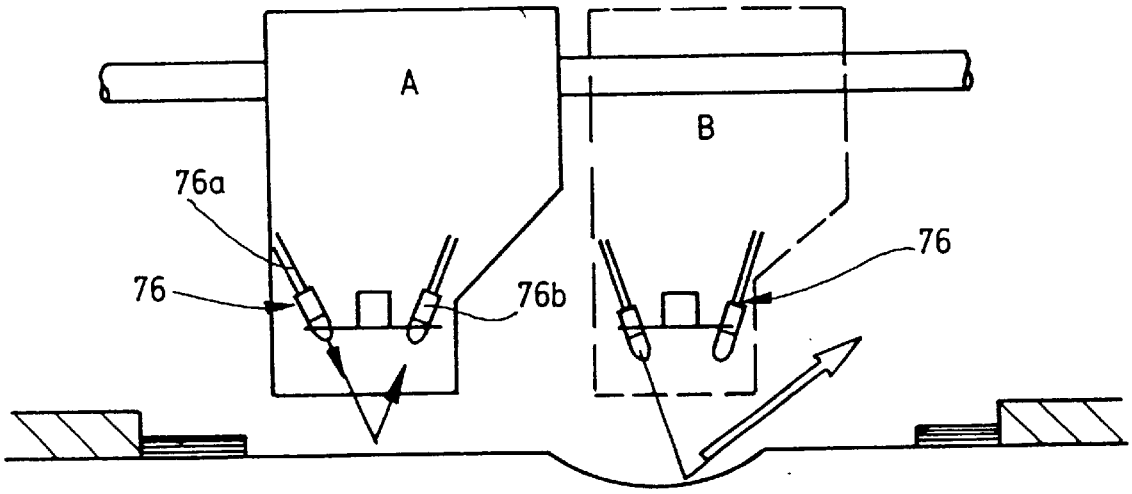

FIGS. 4*b* and 4*c* illustrate in more detail how the arrangement of FIG. 4*a* operates to implement "no contact, no printing". In FIGS. 4*b* and 4*c*, the first position of the print cartridge 72 is shown outlined in a full black line and denoted position A. The second position is denoted by a dotted line and is denoted position B. The second position is shown to be over a small dip in the substrate such that the pinwheel 74 loses contact. FIG. 4*b* illustrates how, in moving from position A to position B, the pinwheel 74 loses contact with the substrate over the small dip. FIG. 4*c* illustrates the detector 76 in more detail. Each detector comprises a light emitter 76*a* and a light sensor 76*b*. In position A, light from the emitter 76*a* reaches the sensor 76*b*. In position B, it can be seen that the small dip in the substrate causes light from the emitter 76*a* to be reflected at an angle such that it does not reach the light sensor 76*b*. Thus, a fault condition is detected.

Thus, although the primary function of the pinwheel 74 and motion detector 76 is to monitor surface contact, it can also be used to detect movement of the printer relative to the substrate. In particular this may be achieved by comparing the actual signal received from the detector with a reference signal, the reference being generated by a calibration operation where the printer is held in contact with a substrate and not allowed to move while the printer prints a test pattern.

An alternative arrangement could be to mount at least two separate pinwheel sensors orthogonally with respect to one another within the body of the printer. When the printer is in contact with the substrate and in the printing position, no movement signal will be generated by these sensors. If relative movement occurs between the printer and the substrate, a signal will be generated by one or both of the sensors and a fault condition flagged.

Figure 4D:
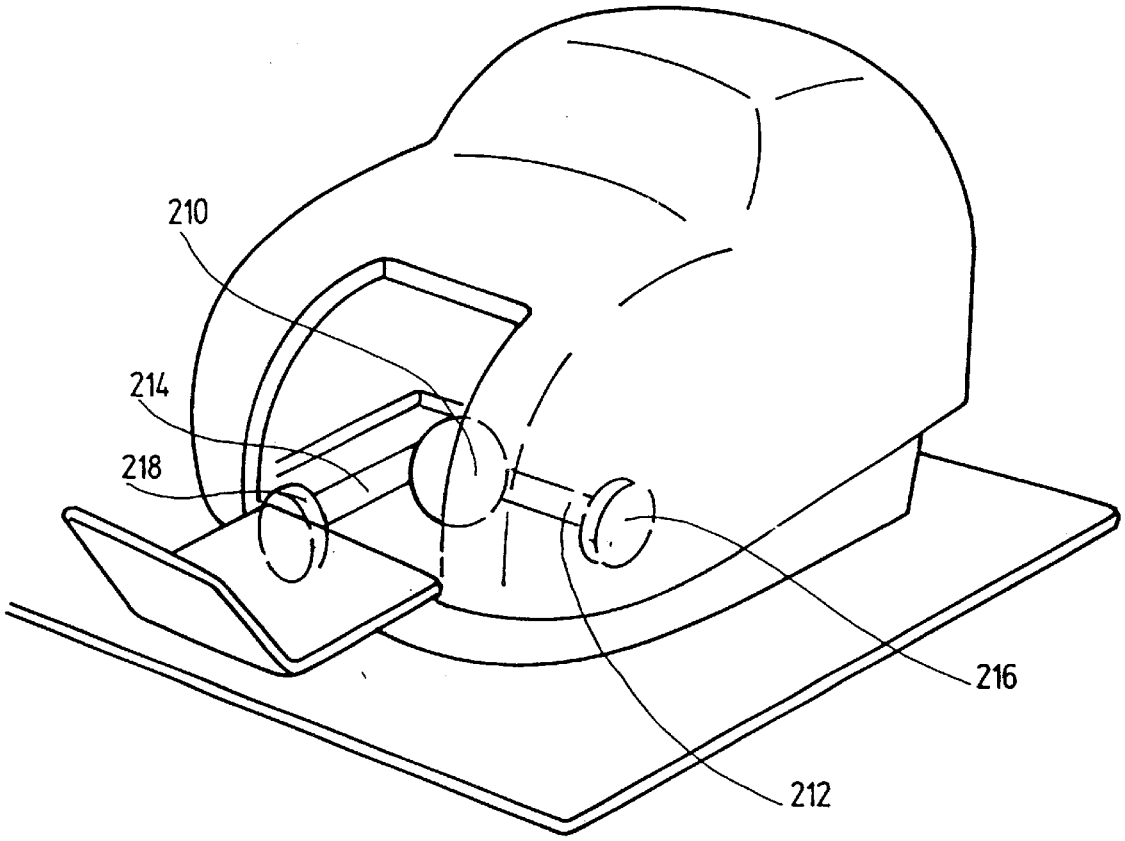
FIG. 4*d* illustrates an embodiment of a motion detector.

A further movement detection technique could be to use a two dimensional detection system as illustrated in FIG. 4*d*. A heavy ball 210 has a high friction outer surface against which rests two orthogonal shafts 212,214. Attached to these shafts are respective rotary encoders 216,218. When the printer contacts the substrate, the ball rests on the substrate and any movement of the printer relative to the substrate is converted to a movement of one or other or both of the encoders.

Figure 5:
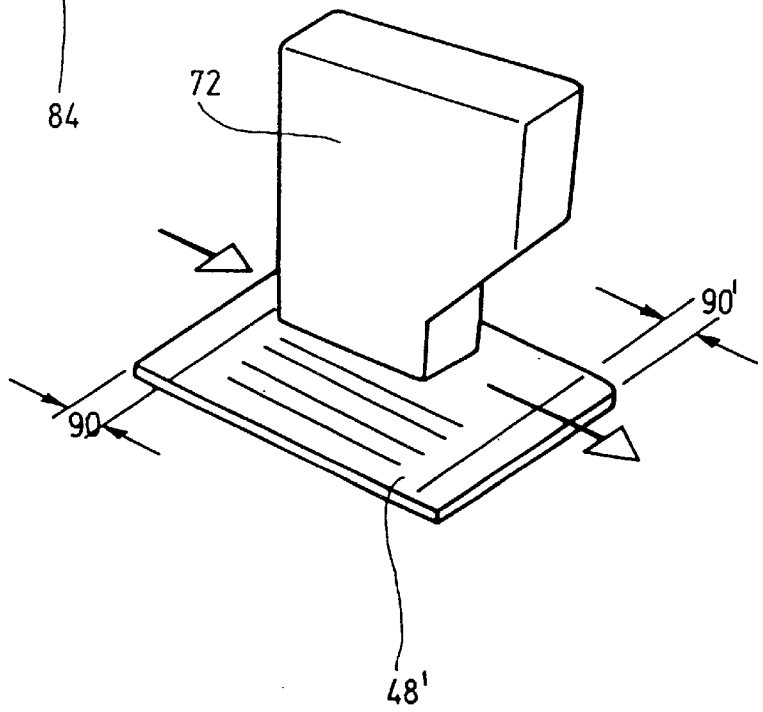
FIG. 5 illustrates the operation mode of the printhead.

FIG. 5 illustrates how scanning is performed over the image receiving medium. Most ink jet printers known in the prior art accelerate the print cartridge from rest to normal printing speed prior to firing the ink droplets. This simplifies the control of ink droplet spacing and allows the print head to be fired at a optimum frequency, but the additional space required to accelerate the print cartridge increases the overall size of the product. The printer described here is hand held and thus requires that the overall dimensions are minimised. The control system of the print cartridge 72 thus provides the ability to print as the print cartridge assembly is accelerating—during printing of the left margin 90 of the image receiving medium 48'—and decelerating—during print of the right margin 90' of the image receiving medium 48'—at the start and finish of each sweep of the mechanism thus enabling the product dimensions to be minimized for a given size of the print area on the image receiving medium.

The drive signals issued by the controller 100 to the DC motors 134 and 136 thus follow a repeatable profile under normal printing loads. Should the mechanism jam or encounter a higher resistance than normal, the drive motor current requirement for the motors will rise. If boundaries are set that encompass the normal operating currents, then currents outside this area may be detected as a fault condition and the appropriate action taken to stop printing. Thus, reverting to FIG. 2, the DC motor 134 is controlled by drive signal 154 and the DC motor 138 is controlled by drive signal 158. Feedback signals 164 and 168 respectively return the back EMF conditions of the motor to the controller 100. This allows the controller to monitor the profile boundary and to detect the fault condition.

Figure 6A:
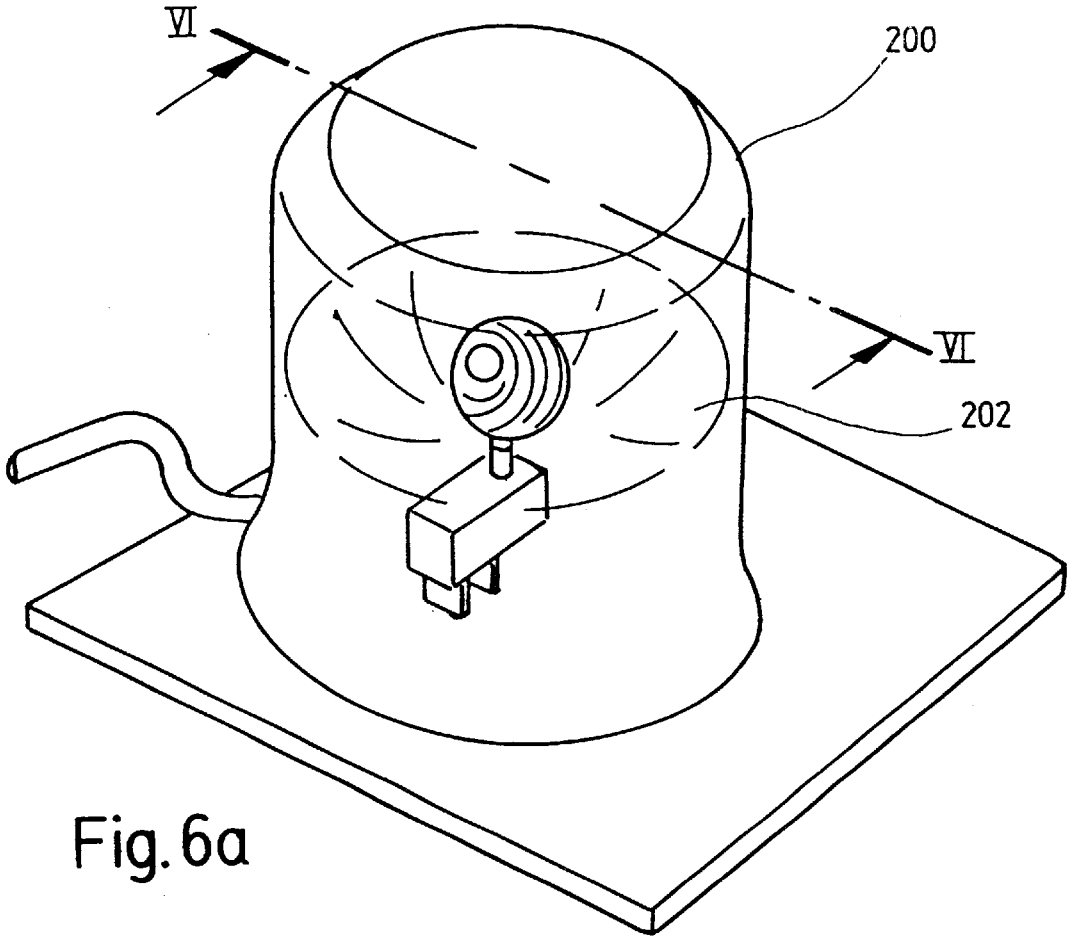
FIGS. 6*a* and 6*b* illustrate a tilt sensor.
Figure 6B:
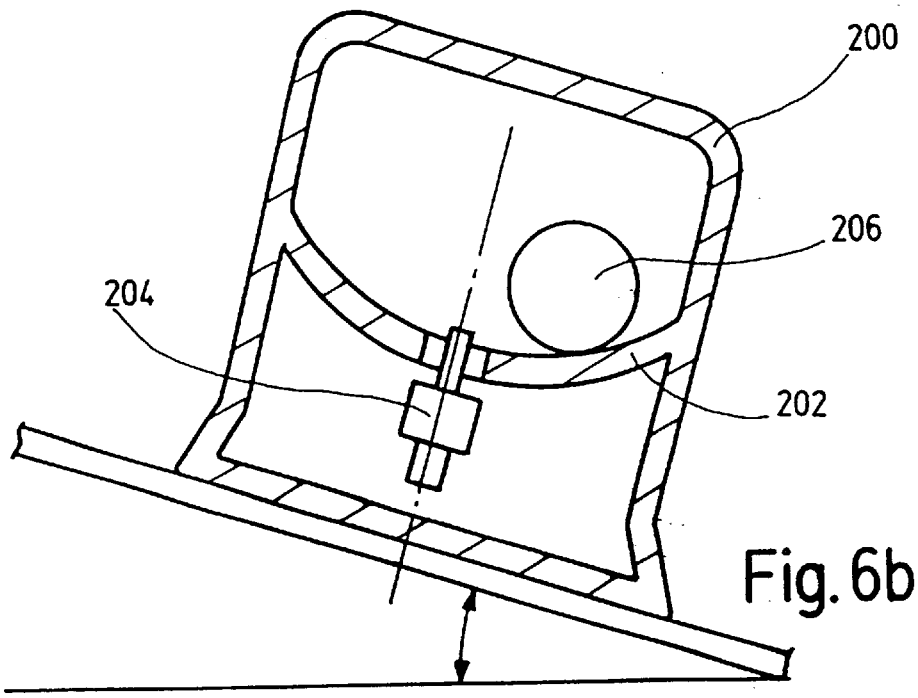

It is important when the printer 24 has been aligned at a print location and is executing printing that the printer is correctly oriented while printing is being effected. That is, it is important that the printer 24 is placed squarely at the print location and is not tilted at an angle. That is, the print head 126 should desirably move in a plane parallel to the plane on which printing is to be effected. The tilt sensor of FIGS. 6*a* and 6*b* allows this to be achieved. The tilt sensor comprises a housing 200 which defines therein a part-spherical or "bowl-shaped" surface 202. As can be seen, FIG. 6*b* is a section taken along lines VI—VI of FIG. 6*a*, but with the tilt sensor in a different position in each figure. At the lowermost point of the part-spherical surface 202, a microswitch 204 is located. A ball 206 rolls freely on the part-spherical surface 202 and can roll in any radial direction. In FIG. 6*a*, the tilt sensor is shown in its properly oriented position, with the ball 206 located over the microswitch 204. This state is detected as a safe state, and printing is allowed to continue while the ball remains in that position. If however the unit moves, the ball will roll away from the centralised position over the microswitch, allowing the microswitch 204 to detect the absence of the ball 206, as illustrated for example in FIG. 6*b*. This is detected as a fault condition, and printing is inhibited. This allows movement of the printer during printing to be detected and printing to be inhibited accordingly.

It will also be apparent that if the printer is placed at the printing location in anything other than the correct orientation, the ball 206 will not be over the microswitch 204 and thus the fault condition will immediately be detected even prior to printing. The printer must be properly aligned vertically before printing can be effected.

Figure 7:
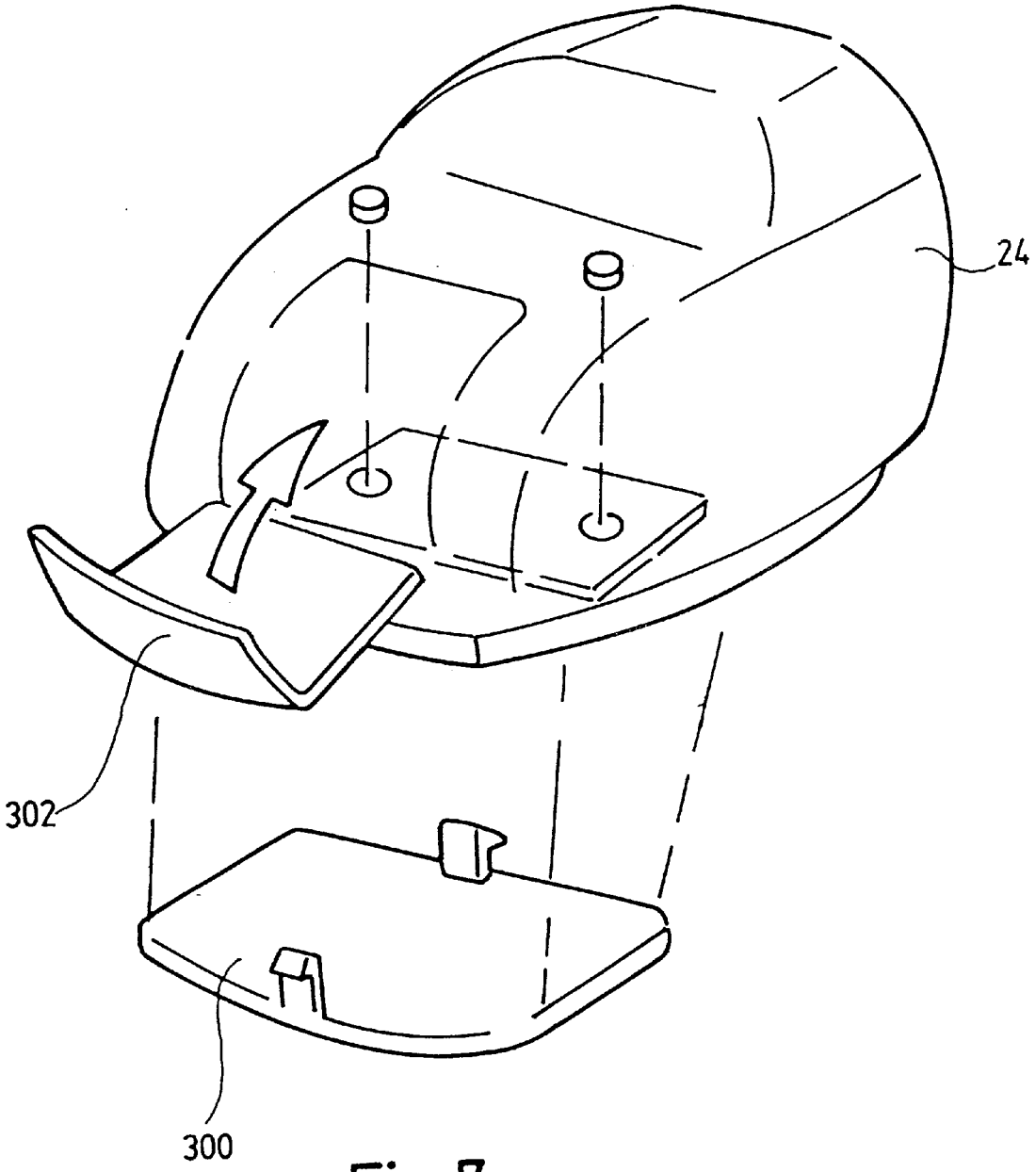
FIG. 7 illustrates the printer with a dust cover.

FIG. 7 illustrates the printer 24 with a sealing lid or dust cover 300 attachable to the printer 24 to close the print face 11 in the base of the printer. In addition, a window 302 is hinged to the housing of the printer 24 whereby the window can be releasably hinged or fixed to the printer 24.

In accordance with one embodiment, when the printer 24 is returned to the base station 20, the printer 24 automatically cycles through a service routine to maintain the print cartridge performance. This sequence is triggered by a switch 304 (FIG. 1) in the base station which senses return of the printer to the base station 20. The service routine can be determined by the supplier of the ink jet cartridge such as to maintain the print cartridge performance.

What is claimed is:

1. A printer comprising:

a housing arranged to be manually positioned on an image receiving medium at a printing location and defining an area over which printing is effected;

a printing mechanism operable to effect printing over said area with the housing at said printing location;

means for detecting relative movement between the image receiving medium and the housing during printing; and a controller for inhibiting printing when such relative movement is detected.

2. A printer according to claim 1, wherein the printing mechanism comprises a print head having a plurality of ink jet nozzles and mounted in said housing for travel within said housing relative to the image receiving medium.

3. A printer according to claim 1, wherein:

the housing has an opening defining an area over which printing is effected;

further comprising a print head having a plurality of ink jet nozzles and mounted in said housing for travel within said housing relative to the image receiving medium to effect printing, said print head travelling at least within said opening and over said area to effect printing; and a cover removably attachable to said housing to close said opening when said printer is not in use.

4. The printer of claim 1, further comprising a base station configured to receive the printer when not in use.

5. The printer of claim 4, wherein the printer and base station are configured to initiate a maintenance sequence for the printer upon return of the printer to the base station.

6. The printer of claim 5, wherein the printer comprises a print head cartridge, and the maintenance sequence operates to maintain the print head cartridge.

7. The printer of claim 5, wherein the printer comprises a switch configured to sense the return of the printer to the base station.

8. A printer comprising:

a housing arranged to be manually positioned on an image receiving medium and defining an area over which printing is effected;

a print head having a plurality of ink jet nozzles and mounted in said housing for travel within said housing relative to the image receiving medium to effect printing, said print head having an extent of travel which extends in a region outside the printing area;

a controller for actuating said ink jet nozzles in said region as a maintenance procedure; and a set of absorbent strips arranged in said region for receiving ink ejected from the jet nozzles during the maintenance procedure.

9. A printer comprising:

a housing arranged to be manually positioned on an image receiving medium at a printing location and defining an area over which printing is effected;

a print head mounted in said housing for travel within said housing relative to the image receiving medium to effect printing;

a motor for driving said print head under the control of a drive signal; and a controller for generating the drive signal for the motor wherein the controller includes fault condition detecting means which are operable to detect when the drive signal exceeds a predetermined limit and to inhibit printing in said fault condition.

10. A printer according to claim 9, wherein the drive signal is an electric current.

11. A printer comprising:

a housing arranged to be manually positioned on an image receiving medium at a printing location and defining an area over which printing is effected;

a printing mechanism operable to effect printing over said area with the housing at said printing location;

means for detecting orientation of the housing; and a controller for inhibiting printing when an orientation other than a vertical orientation is detected.

12. A printer comprising:

a housing arranged to be manually positioned on an image receiving medium at a printing location and defining an area over which printing is effected;

a printing mechanism operable to effect printing over said area with the housing at said printing location;

means for detecting orientation of the housing, said means comprising a curved surface located within said housing and an element which rolls over said surface and which adopts a safe state in a correct predetermined orientation of the printer; and a controller for inhibiting printing when an orientation other than the correct predetermined orientation is detected.

* * * * *